US005285589A

United States Patent [19]

Hyatt

[11] Patent Number: 5,285,589

[45] Date of Patent: Feb. 15, 1994

[54] TELEPHONE INFORMATION FILE

[76] Inventor: Jeffrey L. Hyatt, 1543 Crypress Trace Dr., Melbourne, Fla. 32940-1627

[21] Appl. No.: 950,144

[22] Filed: Sep. 24, 1992

[51] Int. Cl.[5] ..... G09F 11/00

[52] U.S. Cl. ..... 40/375; 40/491

[58] Field of Search ..... 40/375, 491

[56] References Cited

U.S. PATENT DOCUMENTS

| | | | |
|---|---|---|---|
| 1,557,924 | 10/1925 | Craig | 40/375 |
| 2,064,749 | 12/1936 | Huber | 40/491 |
| 3,604,133 | 9/1971 | Hawa | 40/491 |
| 3,991,495 | 11/1976 | Wilson | 40/375 |

FOREIGN PATENT DOCUMENTS

| | | | |
|---|---|---|---|
| 273095 | 9/1913 | Fed. Rep. of Germany | 40/491 |
| 487441 | 12/1953 | Italy | 40/491 |

*Primary Examiner*—Kenneth J. Dorner
*Assistant Examiner*—C. Hope Davis
*Attorney, Agent, or Firm*—Leon Gilden

[57] ABSTRACT

A tubular housing includes a medially positioned intermediate web extending from a bottom wall of the housing to a transparent top wall thereof, having first and second message plates arranged for sliding in telescoping reception relative to the tubular housing, with the intermediate web and the message plates including abutment flaps in cooperative relationship to guide, display and limit projection of the message plates relative to the intermediate web.

3 Claims, 4 Drawing Sheets

TELEPHONE INFORMATION FILE

BACKGROUND OF THE INVENTION

1. Field of the Invention

The field of invention relates to message support structure, and more particularly pertains to a new and improved telephone information file wherein the same is arranged for mounting to an associated telephone for ease of access to telephone numbers and the like for recall thereof in use in telephoning.

2. Description of the Prior Art

Typical storage of telephone numbers require various components as utilized in the prior art such as rotary files or message books typically inconveniently oriented relative to an associated telephone and of a bulky and awkward construction. The instant invention attempts to overcome deficiencies of the prior art by providing for a file structure arranged of compact and easily accessed informational construction for use by individuals and in this respect, the present invention substantially fulfills this need.

SUMMARY OF THE INVENTION

In view of the foregoing disadvantages inherent in the known types of information apparatus now present in the prior art, the present invention provides a telephone information file wherein the same is arranged for mounting to an associated telephone for storage and retrieval of information. As such, the general purpose of the present invention, which will be described subsequently in greater detail, is to provide a new and improved telephone information file which has all the advantages of the prior art message information storage structure and none of the disadvantages.

To attain this, the present invention provides a tubular housing including a medially positioned intermediate web (which in some embodiments may function as a message plate extending from a bottom wall of the housing to a transparent top wall thereof, having first and second message plates arranged for sliding in telescoping reception relative to the tubular housing, with the intermediate web and the message plates including abutment flaps in cooperative relationship to guide, display, and limit projection of the message plates relative to the intermediate web.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved telephone information file which has all the advantages of the prior art message information structure and none of the disadvantages.

It is another object of the present invention to provide a new and improved telephone information file which may be easily and efficiently manufactured and marketed.

It is a further object of the present invention to provide a new and improved telephone information file which is of a durable and reliable construction.

An even further object of the present invention is to provide a new and improved telephone information file which is susceptible of a low cost of manufacture with regard to both materials and labor, and which accordingly is then susceptible of low prices of sale to the consuming public, thereby making such telephone information files economically available to the buying public.

Still yet another object of the present invention is to provide a new and improved telephone information file which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
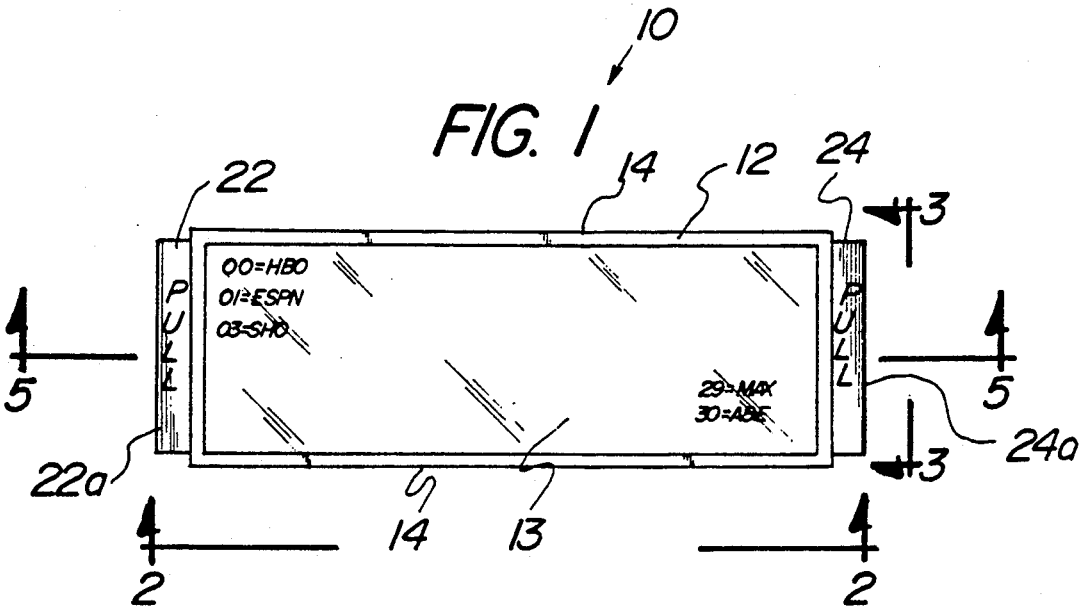
FIG. 1 is an orthographic view of the instant invention.
Figure 2:
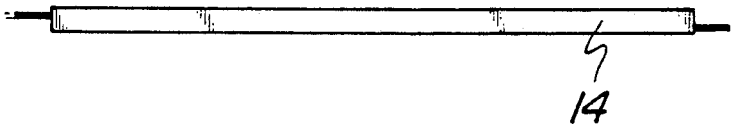
FIG. 2 is an orthographic view, taken along the lines 2—2 of FIG. 1 in the direction indicated by the arrows.
Figure 3:
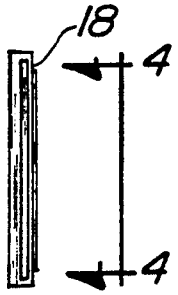
FIG. 3 is an orthographic view, taken along the lines 3—3 of FIG. 1 in the direction indicated by the arrows.
Figure 6:
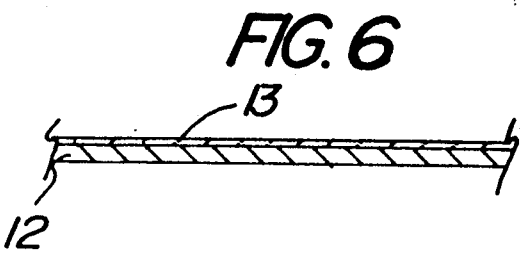
FIG. 6 is an orthographic view of section 6, as set forth in FIG. 5.
Figure 4:
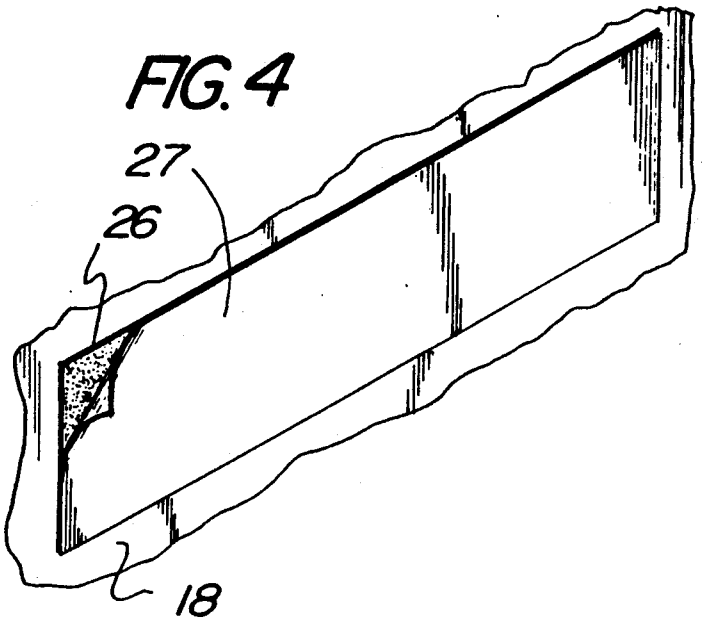
FIG. 4 is an orthographic view, taken along the lines 4—4 of FIG. 3 in the direction indicated by the arrows.

With reference now to the drawings, and in particular to FIGS. 1 to 9 thereof, a new and improved telephone information file embodying the principles and concepts of the present invention and generally designated by the reference numeral 10 will be described.

More specifically, the telephone information file 10 of the instant invention essentially comprises an elongate tubular housing 11 having a parallelepiped configuration, including a parallelepiped housing cavity 15 coextensive with the housing 11. The housing further includes a top wall 12 spaced from a bottom wall 18, with spaced parallel side walls 14. A first end of the housing 11 includes a first entrance opening, with a second end of the housing having a second entrance opening 17 that are coextensive relative to one another. An intermediate web 19 extends from the housing bottom wall at an intersection of the housing bottom wall with the first entrances opening to the top wall 12 at an intersection with the housing second entrance opening. The intermediate web includes a first abutment flange 20 at its first end, and a second abutment flange 21, with the first and second abutment flanges fixedly mounted to the intermediate web adjacent the first and second ends of the intermediate web, having respective first and second included angles of the first and second abutment flanges relative to the intermediate web 19. The message plate 22 is telescopingly mounted from within the tubular housing 11, and more specifically from the cavity 15, with the first message plate 22 having a first end 22*a* oriented in adjacency to the first entrance opening 16, and a second message plate end 22*b* positioned within the cavity 15. The first message plate includes a first message plate abutment flange 23 defining an acute included angle relative to the first message plate 22 positioned within the cavity 15 and in facing relationship to the intermediate web first abutment flanges 20. The second message plate 24 includes a second message plate first and second end 24*a* and 24*b* respectively, with the second message plate first end 24*a* positioned in adjacency to the second entrance opening 17. The second message plate second end includes a second message plate abutment flap 25 dividing a fourth included angle positioned within the cavity 15 in facing relationship relative to the second abutment flange 21. In this manner, limited extension of the first and second message plates 22 and 23 relative to the housing 11 are provided by engagement of the first and second abutment flanges 20 and 21 with respective first and second message plate abutment flanges 23 and 25.

Figure 5:
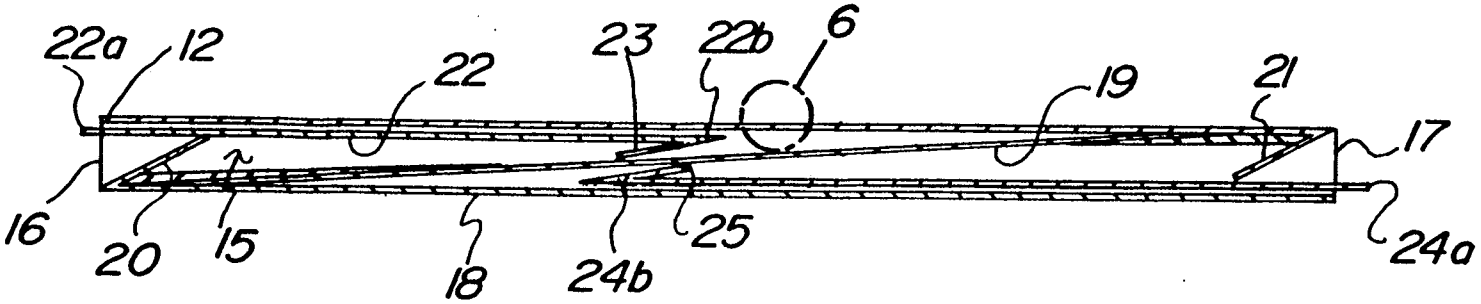
FIG. 5 is an orthographic view, taken along the lines 5—5 of FIG. 1 in the direction indicated by the arrows.
Figure 7:
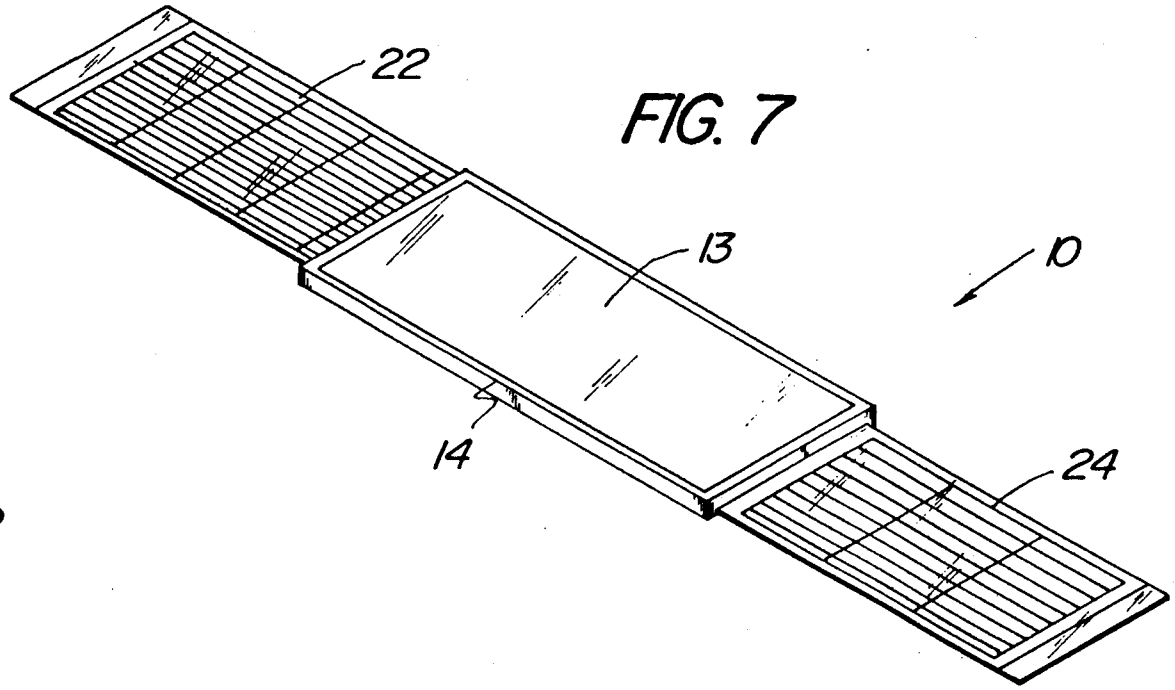
FIG. 7 is an isometric illustration of the invention.
Figure 8:
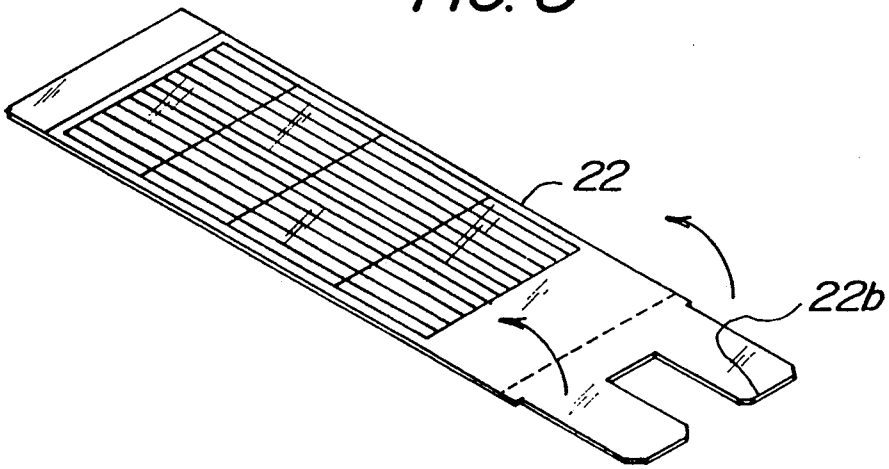
FIG. 8 is an orthographic end view of a construction of a message plate member.

In some embodiments the intermediate web 19 functions as a non-telescoping, removable, message plate; in such embodiment, abutment flanges 21 and 12 may be fixedly mounted to the top and bottom housing walls 12 and 18 (FIG. 5).

To permit ease of mounting to a conventional telephone of the organization, an adhesive web 26 is mounted to the housing bottom wall 18 exteriorly of the housing, with a cover web 27 arranged for removal of the adhesive web to expose the adhesive web for mounting to the associated telephone (not shown).

Figure 9:
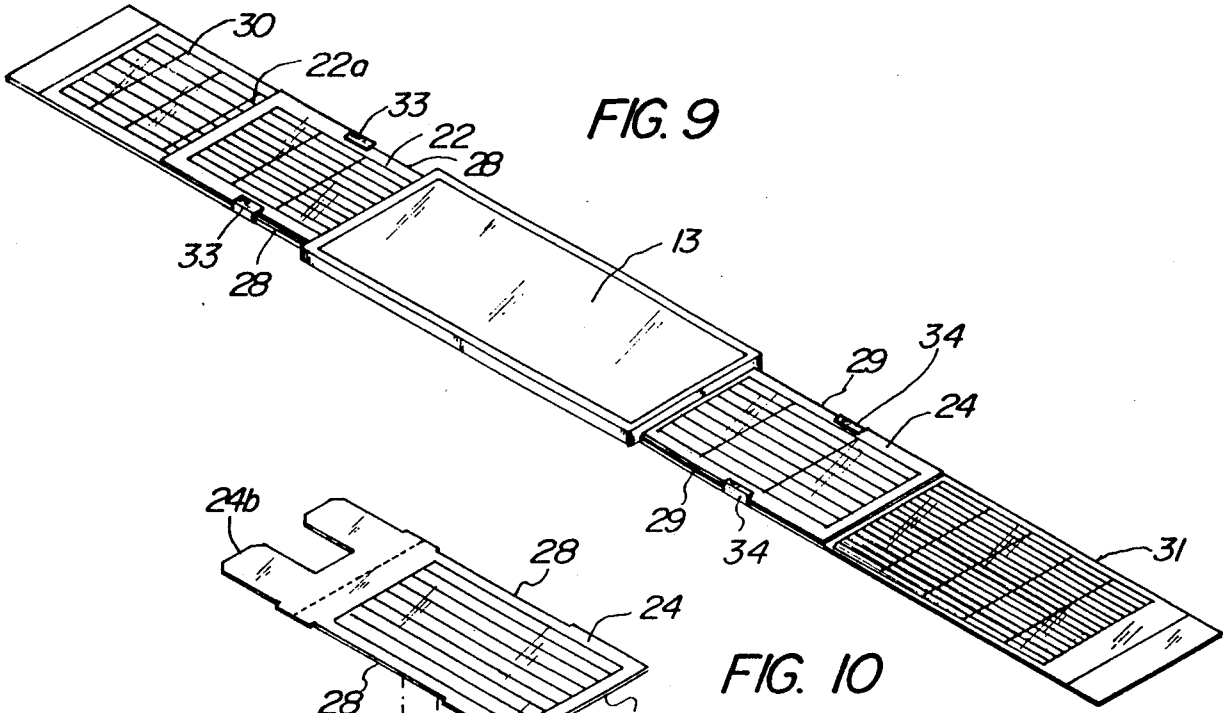
FIG. 9 is an isometric illustration of the invention utilizing additional message plate members.
Figure 10:
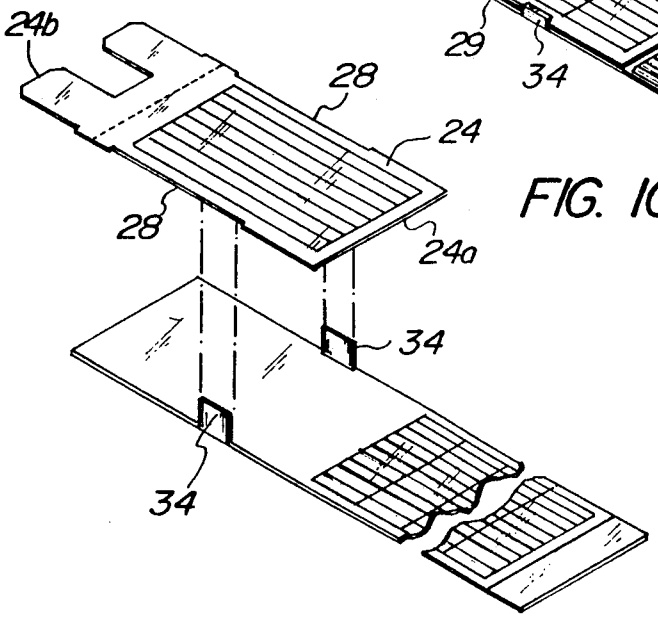
FIG. 10 is an isometric illustration indicating in an exploded view association of a message plate with an extension message plate.

The organization as indicated in the FIG. 9 includes the first and second message plates having first and second message plate pairs of side edge recesses 28 and 29. The first pair of recesses 28 are arranged in a parallel coextensive relationship as are the second pair of recesses 29. Respective third and fourth message plates 30 and 31 are mounted to the first and second mounting plates as the third and fourth mounting plates have respective third and fourth flanges 32 and 33. The third flanges 32 are slidably positioned within the first message plate side edge recesses 28, with the fourth message plate flanges 33 slidably received within the second message plate side edge recesses 29 to limit projection of the third and fourth message plates relative to the respective first and second message plates. In this manner, extensive message recording such as telephone numbers and the like may be imparted upon the respective message plates of the invention, wherein the compact and telescoping nature of the structure permits ease of recall of various components of the invention for access to telephone numbers and information thereon.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A telephone information file, comprising, a tubular housing, the tubular housing having a parallelepiped configuration, including a housing cavity coextensive with the tubular housing, the housing having a top wall spaced from a bottom wall, and spaced parallel side walls, and a first end and second end, the first end having a first end entrance opening and the second end having a second end entrance opening, with a first message plate reciprocatably mounted within the tubular housing extensive relative to the first end entrance opening, and a second message plate reciprocatably mounted within the housing cavity extensive from the tubular housing and the second end entrance opening;

the first message plate includes a first abutment flange oriented at a first included angle relative to the first message plate positioned within the cavity, and the second message plate having a second abutment flange positioned within the cavity spaced from the second end entrance opening and the first message plate projecting from the first entrance opening and the second message plate projecting from the second entrance opening, and an intermediate web having an intermediate web first abutment flange having a predetermined included acute angle relative to the intermediate web, with the intermediate web first abutment flange positioned in adjacency to the first end entrance opening in facing relationship relative to the first message plate abutment flange, and an intermediate web second abutment flange mounted fixedly to the intermediate web at a further predetermined acute angle positioned in adjacency to the second entrance opening and in confronting facing relationship relative to the second message plate abutment flap.

2. An information file as set forth in Claim 1 wherein the bottom wall includes an adhesive web positioned exteriorly of the tubular housing, and the adhesive web having a coextensive flexible cover web removably mounted relative to the adhesive web to permit mounting of the tubular housing to a predetermined support.

3. An information file as set forth in Claim 2 wherein the first message plate includes first side edges, the second message plate includes second side edges, where the first side edges include parallel and coextensive first recesses and the second side edges include parallel and coextensive second side edges, and a third message plate, where the third plate has third message plate flanges positioned within the first side edge recesses, with a fourth message plate having fourth flanges positioned within the second side edge recesses.

* * * * *